US010046961B2

(12) United States Patent
Miner

(10) Patent No.: US 10,046,961 B2
(45) Date of Patent: Aug. 14, 2018

(54) BEVERAGE CONTAINER WHICH PROMOTES SHELF-LIFE

(71) Applicant: Stuart Miner, Decatur, GA (US)

(72) Inventor: Stuart Miner, Decatur, GA (US)

( * ) Notice: Subject to any disclaimer, the term of this patent is extended or adjusted under 35 U.S.C. 154(b) by 23 days.

(21) Appl. No.: 15/354,817

(22) Filed: Nov. 17, 2016

(65) Prior Publication Data

US 2018/0134541 A1 May 17, 2018

(51) Int. Cl.
*B67D 3/00* (2006.01)
*B67D 3/04* (2006.01)

(52) U.S. Cl.
CPC ..... *B67D 3/0032* (2013.01); *B67D 3/042* (2013.01); *B67D 3/047* (2013.01)

(58) Field of Classification Search
CPC ..... B67D 3/0032; B67D 3/042; B67D 3/047
USPC ..... 222/105, 481.5; 53/467; 215/269
See application file for complete search history.

(56) References Cited

U.S. PATENT DOCUMENTS 3,540,694 A * 11/1970 Cornelius ..... B67D 3/047 251/209
4,475,670 A * 10/1984 Rutter ..... B65D 77/067 222/105
7,597,124 B2 * 10/2009 Litto ..... B67D 1/0878 141/114
2010/0018994 A1 * 1/2010 Antheil ..... B65D 21/0231 222/105
2014/0246396 A1 * 9/2014 Jepson ..... B65D 81/245 215/260
2015/0259105 A1 * 9/2015 Martinez ..... B65D 39/0052 220/233

* cited by examiner

*Primary Examiner* — Donnell Long
(74) *Attorney, Agent, or Firm* — Smith, Gambrell & Russell, LLP.

(57) ABSTRACT

A closure system suitable for sealing a growler and dispensing beer under the influence of gravity and atmospheric pressure through a conventional tap faucet. A growler sealed with the closure system is held in an inverted position by a support system. The closure system is lower than the body of the growler and is connected to a conventional tap faucet. The closure system includes a cap with a manually operated valve. The valve rotates from a closed position to an open one, which opens two channels in the cap: one to conduct beer from the growler to the tap and the other to conduct ambient air into a collapsed bladder—which is an integral part of the cap—when the tap is opened to dispense beer. The collapsible bladder expands into the growler when the beer is dispensed to take up the volume vacated by the beer. The closure system and the support can be included in a kit, alternatively each component can be packaged as a stand-alone item.

30 Claims, 10 Drawing Sheets

FIG. 3A
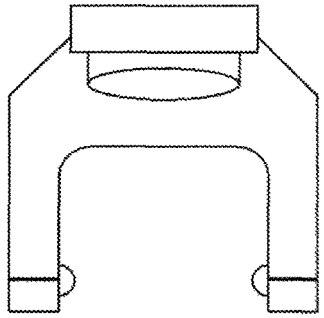
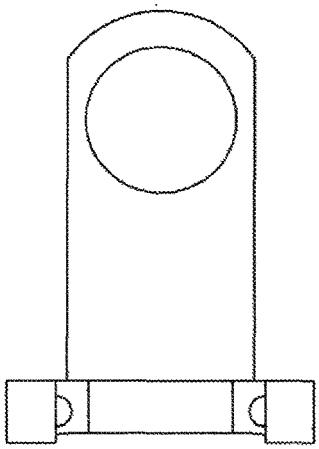
FIG. 3B
FIG. 3D
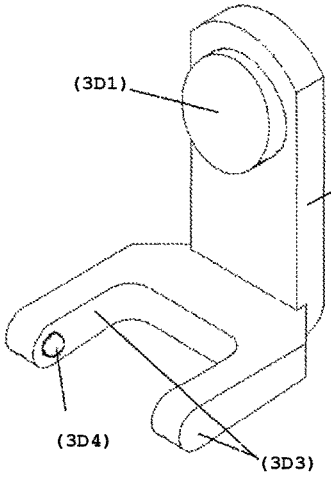
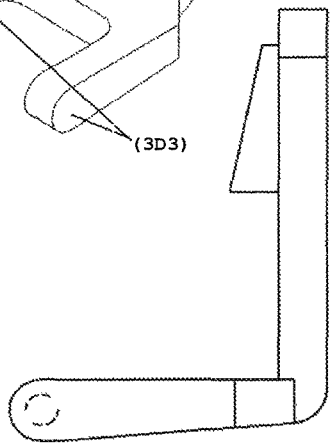
FIG. 3C

FIG. 6A
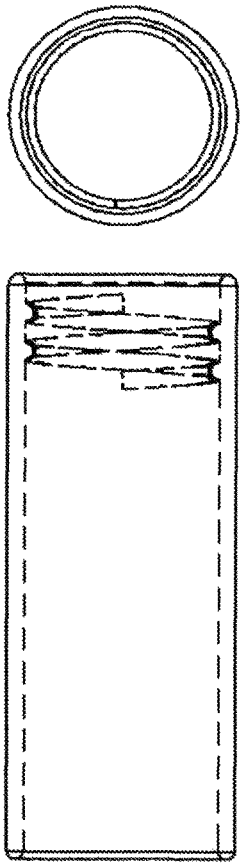
FIG. 6B
FIG. 6C
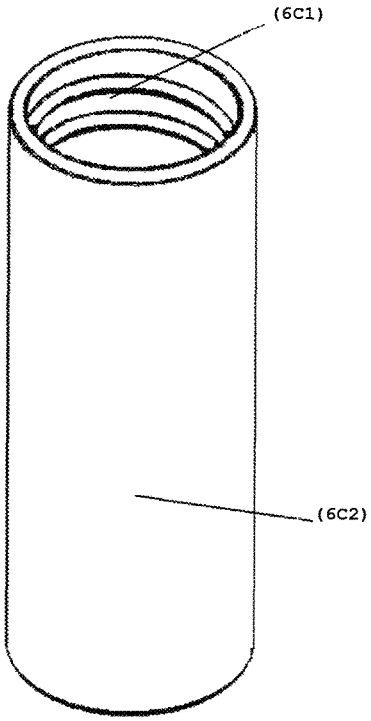

FIG. 7A
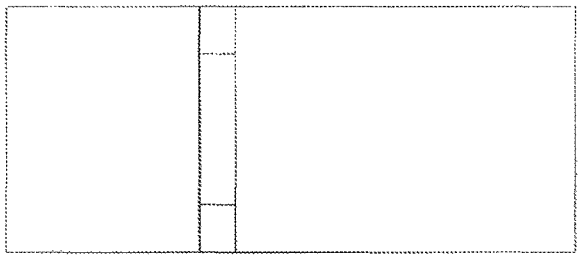
FIG. 7D
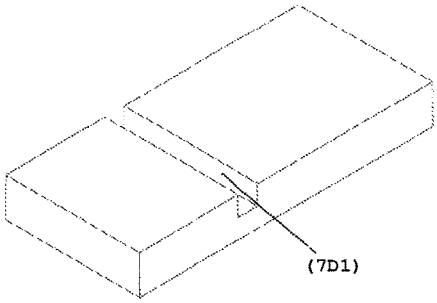
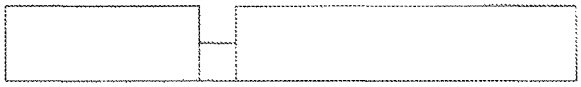
FIG. 7B
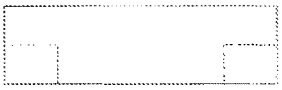
FIG. 7C

FIG. 8A
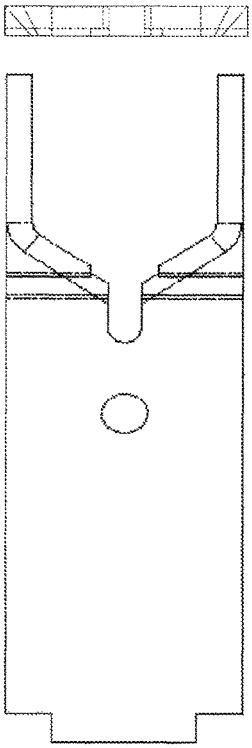
FIG. 8B
FIG. 8C
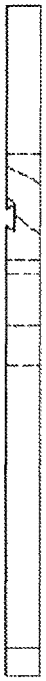
FIG. 8D
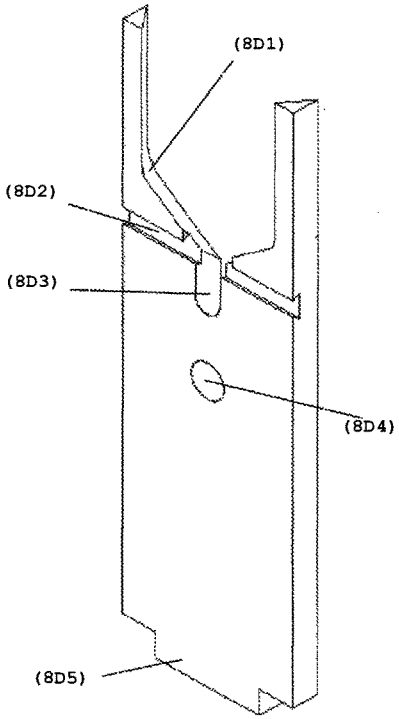

FIG. 9A
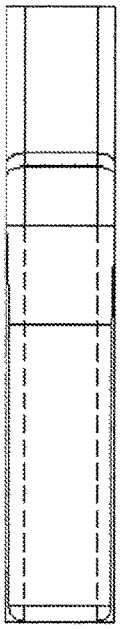
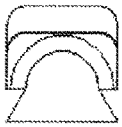
FIG. 9B
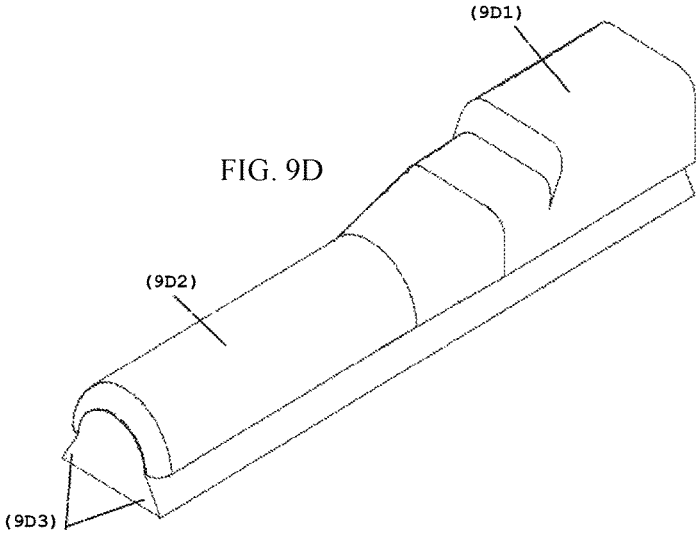
FIG. 9D
FIG. 9C
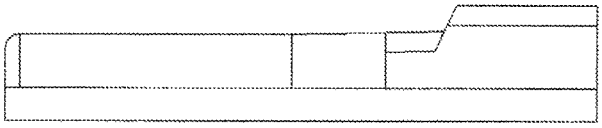

FIG. 10B
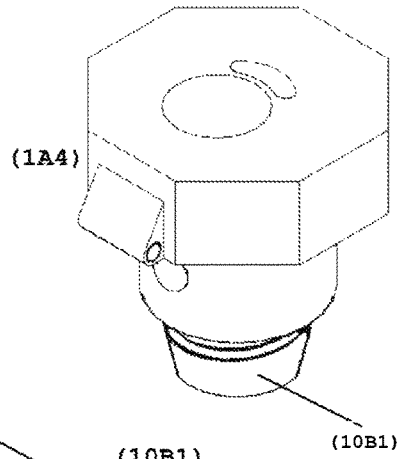
FIG. 10A
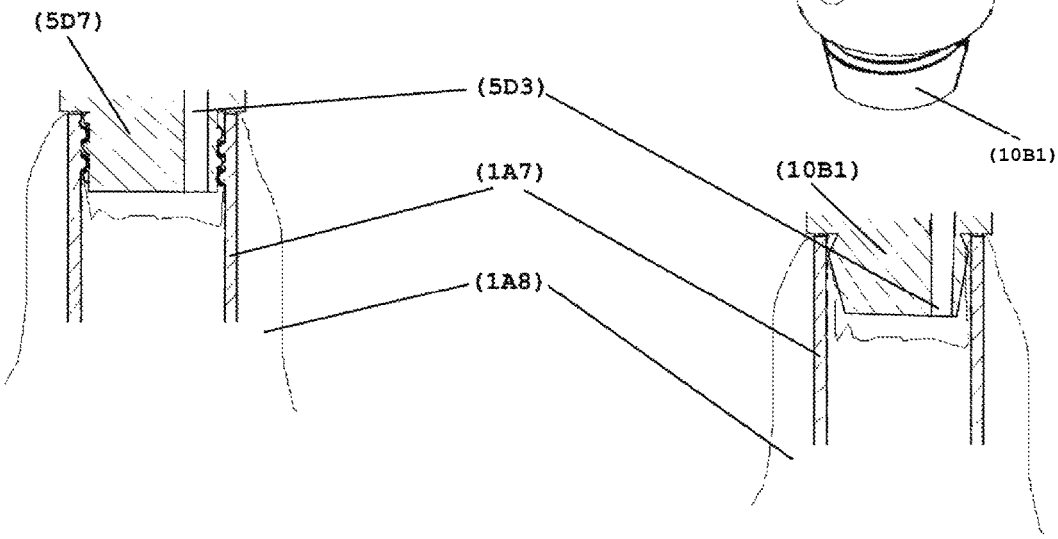
FIG. 10C

BEVERAGE CONTAINER WHICH PROMOTES SHELF-LIFE

FIELD OF INVENTION

This invention generally relates to a closure system that dispenses liquid from an existing sealed, fixed volume, solid vessel system through a valve using atmospheric pressure and gravity without exposing the liquid to air. The closure system is suited for use in dispensing craft beer from a growler.

BACKGROUND OF THE INVENTION

Craft beer is an expanding industry and growlers are convenient containers for the transport of beer from source to home or another desired location. Carbonated beverages, like beer, are fragile and susceptible to deterioration in quality due to a variety of factors including exposure to air or contaminants, such as mold, and the loss of carbonation. The loss of carbonation produces flatness. Contact with air can cause staleness due to oxidation and also affect mouthfeel and the taste of the beverage. Numerous solutions have been proposed to limit air contact. Of relevance here, are the solutions proposed in U.S. Published Application No. 2011/0278297 and U.S. Published Application No. 2014/0246396 since they propose solutions that address beverage contact with air in the head space of a container. The '297 application employs an inflatable bladder to keep the beverage separated from air but the beverage cannot be accessed simultaneously with the bladder excluding air from the vessel, instead the bladder must be deflated and removed to access the beverage and then reinserted and reinflated to reseal the beverage, exposing the beverage to air and promoting oxidation each time these actions are performed. The '396 application employs a rather complex system to minimize air contact with the carbonated beverage. A threaded cap is used to introduce a bladder system to a container. The cap includes an attached dual bladder system, which is used to displace the headspace in a beverage container by either pumping air into the bladder or pressurizing the bladder with carbon dioxide to displace the headspace gas out through a vent in the cap. The inner bladder is designed to hold the pressurized gas without stretching while the outer bladder surrounding the inner bladder is elastic in order to minimize the space the bladders occupy when empty. The use of the system is limited since its use requires a sealed container to have been partially emptied. In addition, the system is complex and presents many challenges and opportunities for failure.

There exists a need for a simpler design that addresses the headspace air contact with the beverage and also aids in dispensing the carbonated beverage without the need of a pressurized system. The systems described above required pressures greater than atmospheric pressure generated by adding compressed air, carbon dioxide, or nitrogen to dispense the beverage.

SUMMARY OF THE INVENTION

The invention is directed towards a closure system and its use to dispense a beverage from existing sealed, fixed volume vessels; in particular craft beer from a growler. Additionally, the closure system design is preferably used in conjunction with a stand, which holds the growler in an inverted position to dispense the beverage, using a gravity induced flow, when a conventional tap is opened.

The invention requires only one bladder and dispenses the beverage using only gravity and atmospheric pressure. It is installed when the container is initially filled and sealed. Any air or gas that would typically fill the headspace of the container as the beverage is poured out is instead trapped inside the collapsible bladder. There it is separated from the beverage by the impermeable material of the bladder, eliminating the requirement to purge headspace gas to avoid contact between the gas and the beverage. The invention includes a closure system and support structure that is designed to allow liquid to flow from existing sealed, fixed volume vessels, i.e. growlers, through existing valve hardware using atmospheric pressure and gravity as the impetus for flow without exposing the liquid to the ambient air. It is primarily intended for use with liquids, i.e. craft beer, that require isolation from air to prevent oxidation, contamination, or other spoilage. The closure system is attached to the growler in order to seal it and serve as the only exit point for the contents of the growler. The closure system has a valve that runs from the interior of the growler through the closure system to the exterior. The closure system also has a port that is open on the exterior and runs to the interior of the growler where it terminates in a collapsible bladder constructed of material that is impermeable to air. The support structure elevates and holds the growler in an inverted orientation that places the closure system at the lowermost portion of the growler allowing gravity to create a pressure gradient that causes the beer to flow from the growler out through the closure system. As the beer leaves the growler; ambient air enters and fills the collapsible bladder allowing it to expand from a storage tube to take up the volume vacated by the beer. This process continues until the liquid contents have been emptied from the growler and the collapsible bladder has filled with air and expanded to take up the entire volume of the growler. (The volume of the bladder can be greater than that of the growler.) During the entire process the beer and air are kept separate by the impermeable bladder material. This prevents oxidation, contamination, or spoilage of the beer. In particular, the exemplified system is designed to work with standard 64 oz glass growlers filled with beer and connected to standard (e.g. ¼ in barbed fittings) beer shank and faucet assemblies. The system is readily adaptable to growlers having different sizes and shapes.

The growler, closure, and support system can be packaged in kit form where the support is disassembled (vertical and horizontal components). The support would be assembled at the site where the beer is to be dispensed. As can be readily recognized, the unique closure system can be sold separately. Other support systems can be used to position growlers sealed with the closure system in an inverted position to dispense the beverage. The closure system can be adapted to use for a variety of growler types. No specific growler type is required for proper operation. The only requirement for the selected support is that it merely has to position the growler to be held in an inverted position so that the liquid contents can be dispensed by gravity using a conventional tap.

BRIEF DESCRIPTION OF THE FIGURES

FIG. 3A shows the Dust Cover (1A1) in an overhead view. FIG. 3B shows the Dust Cover (1A1) in a frontal view. FIG. 3C shows the Dust Cover in a side view. FIG. 3D depicts the Dust Cover in a perspective view showing the Tilt Faced Protrusion (3D1), the Flat Projection (3D2), the Hinge Legs (3D3), and the Semi-spherical Nodes (3D4).

FIG. 6A shows an overhead view of the Bag Tube (1A7). FIG. 6B shows a frontal view of the Bag Tube (1A7). FIG. 6C shows a perspective view showing the Upper Threaded Portion (6C1) and the Smoothbore End (6C2).

FIG. 7A shows an overhead view of the Horizontal Base (2B5). FIG. 7B shows a frontal view. FIG. 7C shows a side view. FIG. 7C shows a perspective view showing the Notch and Keyhole Cutout (7D1).

FIG. 8A shows an overhead view of the Vertical Support (2B4). FIG. 8B shows a frontal view of the Vertical Support (2B4). FIG. 8C shows a side view, FIG. 8D shows a perspective view showing the Wishbone Shaped Cutout (8D1), the Horizontal Groove (8D2), the Spinal Notch (8D3), the Faucet Hole (8D4), and the Foot (8D5) of the support.

FIG. 9A shows the Slide Lock (2B3) in an overhead view. FIG. 9B shows a frontal view (B) of the Slide Lock (2B3) FIG. 9C shows a side view. FIG. 9D shows a perspective view showing the Thumb Grip (9D1), the Seri-Circular Bar (9D2), and the Groove Flanges (9D3).

FIG. 10A shows a cutaway view of the threaded connection between the previously listed Cap (1A4) and Bag Tube (1A7). FIG. 10 B shows a perspective view of the Cap (1A4) with an alternative Lower Tapered Portion (10B1). FIG. 10C shows a cutaway view of the alternative push on connection between the Lower Tapered Portion (10B1) and the entirely smooth inner surfaced Bag Tube (1A7).

DETAILED DESCRIPTION OF THE INVENTION

Embodiments of the invention will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

In the following description, numerous specific details are set forth. However, it is to be understood that embodiments of the invention may be practiced without these specific details. In other instances, well-known methods, structures, and techniques have been shown in detail in order not to obscure an understanding of this description.

Figure 1A:
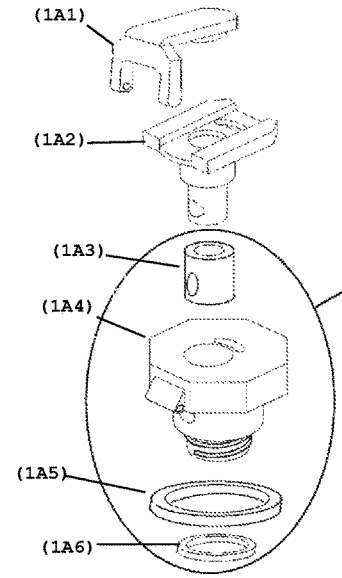
FIG. 1A shows an exploded view of the following component parts: Dust Cover (1A1), Turn Valve (1A2), Inner Gasket (1A3), Cap (1A4), Upper Gasket (1A5), Lower Gasket (1A6), Bag Tube (1A7), and Collapsible Bladder (1A8).
Figure 1B:
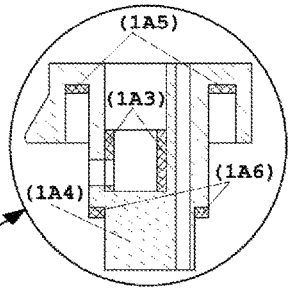
FIG. 1B shows a cutaway view of the assembled locations of the three gaskets (1A3, 1A5, 1A6) relative to the Cap (1A4).
Figure 1D:
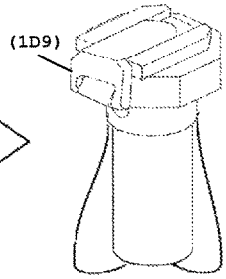
FIG. 1D shows a perspective view of the assembled Closure System (1D9).
Figure 1C:
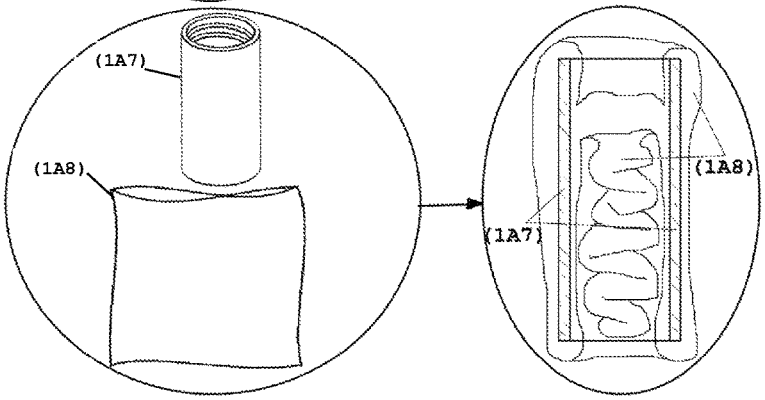
FIG. 1C shows a cutaway view of the Collapsible Bladder (1A8) relative to the Bag Tube (1A7).
Figure 2A:
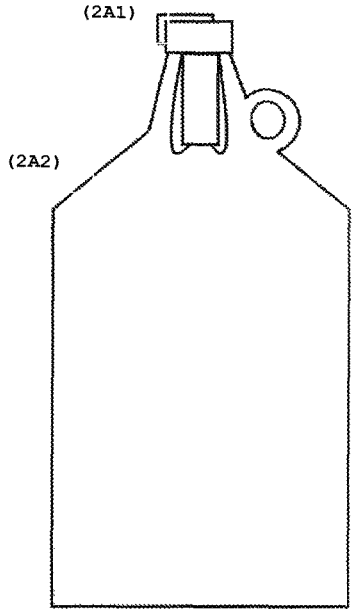
FIG. 2A shows a profile view of a Growler (2A1) having a handle sealed with the assembled Closure System (1D9).
Figure 2B:
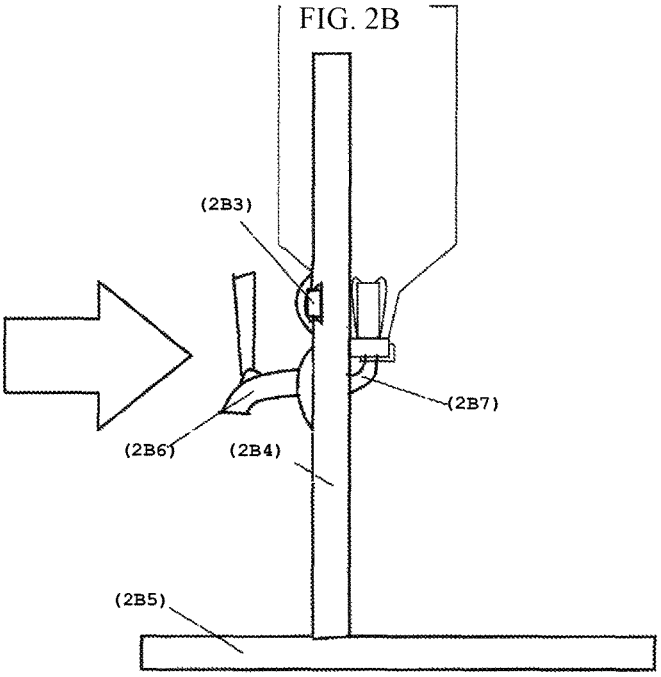
FIG. 2B shows a second profile view depicting the operation of the system where the Growler (2A1) and Closure System (1D9) assembly is secured in an inverted position to the Vertical Support (2B4) by the Slide Lock (2B3) while stabilized by the Horizontal Base (2B5) enabling the liquid contents of the Growler (2A1) to flow out through the Connective Tubing (2B2) and be dispensed by the Tap Faucet (2B6).
Figure 4A:
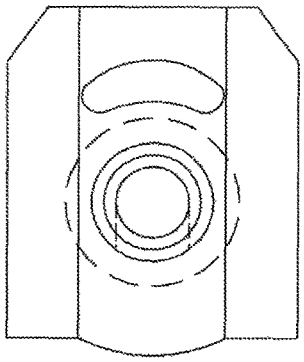
FIG. 4A shows an overhead view of the Turn Valve (1A2).
Figure 4D:
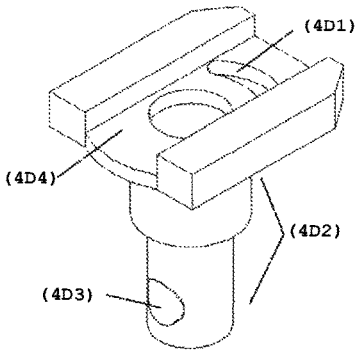
FIG. 4D shows a perspective view of the Turn Valve (1A2) showing the Half Moon Shaped Orifice (4D1), the Stepped Cylindrical Stem (4D2), the Circular Opening (4D3), and the Upper Recess (4D4).
Figure 4B:
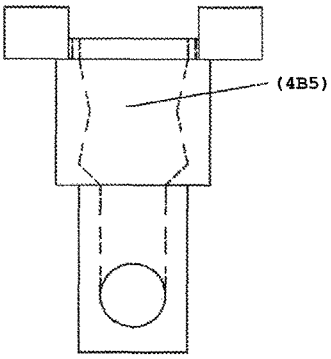
FIG. 4B shows a frontal view of the Turn Valve (1A2) showing the Hour Glass Shaped Void (4B5).
Figure 4C:
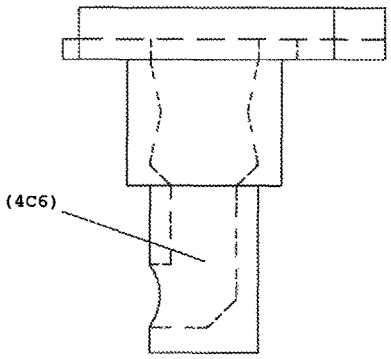
FIG. 4C shows a side view of the Turn Valve (1A2) showing the Liquid Channel (4C6).
Figure 5A:
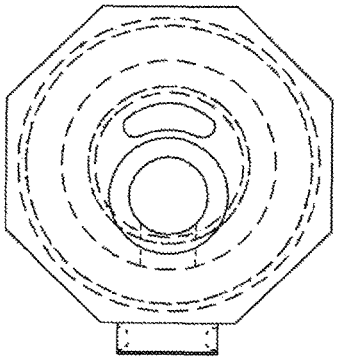
FIG. 5A shows the Cap (1A4) in an overhead view.
Figure 5D:
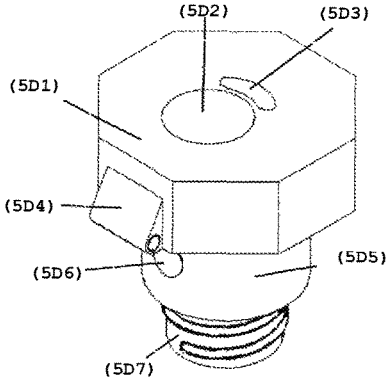
FIG. 5D shows a perspective view showing the Octagonal Threaded Portion (5D1), the Valve Socket (5D2), the Air Channel (5D3), the Hinge Mount (5D4), the Central Barrel (5D5), the Lateral Opening (5D6) of the Valve Socket, and the Lower Threaded Portion (5D7).
Figure 5B:
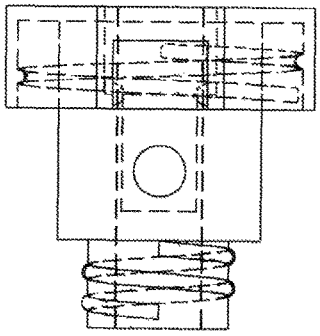
FIG. 5B shows a frontal view of the Cap (1A4).
Figure 5C:
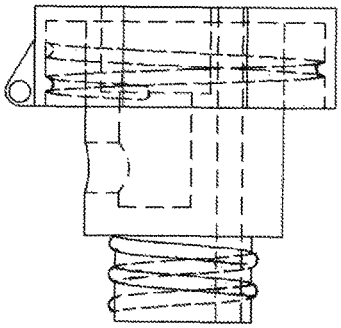
FIG. 5C shows a side view of the Cap (1A4).

The present invention, as shown in FIGS. 1A-10C, is directed towards a growler, a closure system and its component parts, and a support member composed of vertical and horizontal support structures.

Dust Cover (1A1)

The Dust Cover (1A1) is the outermost portion of the Closure System (1D9). The Dust Cover (1A1) can be constructed of a hard, nonporous material; preferably plastic. The Dust Cover's Hinge Legs (3D3) attach via the Hinge Mount (5D4) to the Cap (1A4) and alternatively cover and uncover the Upper Recess (4D4) on the Turn Valve (1A2) to prevent debris from collecting in the Turn Valve (1A2) when the unit is closed and not in use. In the closed position, the Dust Cover's Flat Projection (3D2) with the Tilt Faced Protrusion (3D1) lays in the Upper Recess (4D4) on top of the Turn Valve (1A2) covering the Half Moon Shaped Orifice (4D1) and positively engaging the top of the Hour Glass Shaped Void (4B5) to hold itself closed.

Turn Valve (1A2)

The Turn Valve (1A2) is the next component of the Closure System (1D9). It is constructed of a hard, nonporous material; preferably plastic. Its Stepped Cylindrical Stem (4D2) is inserted into the Valve Socket (5D2) as a male/female connection on the top of the Cap (1A4) and the interior surfaces of the Cap (1A4) and exterior surfaces of the Turn Valve's stem are sufficiently tight to one another to create an air/watertight seal. The Turn Valve (1A2) is opened and closed by rotating it about the long axis of its Stepped Cylindrical Stem (4D2). In the closed position the Half Moon Shaped Orifice (4D1) on the Turn Valve (1A2) is positioned closest to the Hinge Mount (5D4) point of the Cap (1A4). The Circular Opening (4D3) on the lower side of the Stepped Cylindrical Stem (4D2) is turned toward the center axis of the Cap (1A4). The Air Channel (5D3) in the Cap (1A4) is also covered by the flat top of the Turn Valve (1A2) to prevent debris from entering the channel leading to the Collapsible Bladder (1A8). The Turn Valve (1A2) is opened by rotating it 180 degrees from its closed position. This aligns the Half Moon Shaped Orifice (4D1) in the Turn Valve (1A2) with the Air Channel (5D3) in the Cap (1A4) allowing air to enter the channel and flow into the Collapsible Bladder (1A8). The Circular Opening (4D3) on the lower side of the Stepped Cylindrical Stem (4D2) is aligned with the Lateral Opening (5D6) down the side of the Cap (1A4) below the Hinge Mount (5D4). This opening will be exposed to the beer inside the growler which will then enter the Liquid Channel (4C6) and flow out of the vessel through the Turn Valve (1A2). The Hour Glass Shaped Void (4B5) in the upper cylinder of the Stepped Cylindrical Stem (4D2) will accept and impinge on a length of ⅜ in O.D. ¼ in I.D. Connective Tubing (2B2) creating an air/watertight seal and allowing the beer to continue flowing onward to a standard dispensing Tap Faucet (2B6).

Cap (1A4)

The Cap (1A4) is the central component of the Closure System (1D9). It is constructed of a hard, nonporous rubber material that is of firm construction to maintain its shape and hold securely to the growler yet still deformable at the surfaces where it mates with the Turn Valve (1A2), Growler (2A1), and Bag Tube (1A7) to create watertight seals. It may be alternatively constructed of a hard, nonporous material like plastic and utilize an Inner Gasket (1A3), Upper Gasket (1A5), and Lower Gasket (1A6) as depicted in FIG. 1. The Inner Gasket (1A3) interfaces between the Turn Valve (1A2) and the Cap (1A4) in the Valve Socket (5D2) creating a watertight seal around the Liquid Channel (4C6). The Upper Gasket (1A5) interfaces between the Cap (1A4) and the Growler (2A1) creating an air/watertight seal in the recessed ring-shaped area between the interior of the Octagonal Threaded Portion (5D1) and the exterior of the Central Barrel (5D5) of the Cap (1A4) at the Growler's opening. The Lower Gasket (1A6) interfaces between the Central Barrel (5D5) and Bag Tube (1A7) compressing against the mouth of the Collapsible Bladder (1A8) to create an air/watertight seal around the Air Channel (5D3) and the Collapsible Bladder (1A8) inside of the Growler (2A1). The Cap (1A4) connects directly to the vessel and all other components of the closure system attach to it. The Octagonal Threaded Portion (5D1) of the Cap (1A4) will be exterior to the vessel and is threaded to attach securely to the Growler (2A1). The Hinge Mount (5D4) on one face of the octagonal portion has two circular détentes which receive the two Semi-spherical Nodes (3D4) on the Hinge Legs (3D3) of the Dust Cover (1A1). This is the hinged attachment point for the Dust Cover (1A1). Two channels are cut in the top of the Cap (1A4). The half-moon shaped channel is the Air Channel (5D3) that passes all the way from the top of the Cap (1A4) through the Central Barrel (5D5) of the Cap (1A4) and out of the Lower Threaded Portion (5D7) of the Cap (1A4). This channel allows ambient air to flow into and fill the Collapsible Bladder (1A8) inside the growler. The Valve Socket (5D2) is the circular channel that extends from the top of the Cap (1A4) into the Central Barrel (5D5) of the Cap (1A4) and then turns 90 degrees to exit through the Lateral Opening (5D6) of the barrel into the interior of the growler. This circular channel receives the Turn Valve (1A2) and allows the beer to flow out of the growler when the Turn Valve (1A2) is in the open position. The Lower Threaded Portion (5D7) of the Cap (1A4) is the attachment point for the Bag Tube (1A7). Here the Bag Tube (1A7) screws on and compresses the opening of the Collapsible Bladder (1A8) against the underside of the Central Barrel (5D5) creating an air/watertight seal and allowing the Air Channel (5D3) to enter the Collapsible Bladder (1A8). Alternatively, the Lower Threaded Portion (5D7) may be replaced with a Lower Tapered Portion (10B1) allowing the Bag Tube (1A7) to be pushed onto this Lower Tapered. Portion (10B1) compressing the opening of the Collapsible Bladder (1A8) circumferentially against the inner surface of the Smoothbore End (6C2) to create an air/watertight seal.

Bag Tube (1A7)

The Bag Tube (1A7) is the innermost component of the Closure System (1D9). It is constructed of a hard, nonporous material; preferably plastic. It is inserted Smoothbore End (6C2) first into the Collapsible Bladder (1A8), The opening of the Collapsible Bladder (1A8) is then gathered together and tucked inward into the Upper Threaded Portion (6C1) of the Bag Tube (1A7). Ensuring that the gathered opening of the bladder remains tucked into the Upper Threaded Portion (6C1) of the Bag Tube (1A7), the Bag Tube (1A7) is then screwed onto the Lower Threaded Portion (5D7) of the Cap (1A4) until the gathered opening of the bladder is sufficiently compressed between the upper edge of the Bag Tube (1A7) and the underside of the Cap's Central Barrel (5D5) to create an air/watertight seal. The excess material of the Collapsible Bladder (1A8) is then uniformly layered accordion style inside the Smoothbore End (6C2) of the Bag Tube (1A7) for storage. Alternatively, the inner surface of the Bag Tube (1A7) may be uniformly smooth with no screw threads to achieve a push on attachment to the alternative Lower Tapered Portion (10B1) of the Cap (1A4) compressing the opening of the Collapsible Bladder (1A8) circumferentially against the smooth inner surface of the Bag Tube (1A7) to create an air/watertight seal.

Collapsible Bladder (1A8)

The Collapsible Bladder (1A8) is a plastic bag impermeable to air or water having a volume equal to or greater than the internal volume of the Growler (2A1). The material thickness of the Collapsible Bladder (1A8) is 6-12 microns in order for it to easily conform to the surfaces it contacts when compressed between the Bag Tube (1A7) and Cap (1A4) to create an air/watertight seal.

Horizontal Base (2B5)

The Horizontal Base (2B5) is the horizontal portion of the support structure. It is constructed of a hard, stable material; preferably wood. Its length and width create a footprint large enough to provide stability to the entire support structure as well as supporting the weight of the liquid filled Growler (2A1), Closure System (1D9), and the associated Tap Faucet (2B6) and Connective Tubing (2B2) hardware. The Notch and Keyhole Cutout (7D1) that splits the Horizontal Base (2B5) approximately ⅓-⅔ receives the Foot (8D5) of the Vertical Support (2B4).

Vertical Support (2B4)

The Vertical Support (2B4) is the vertical portion of the support structure. It is constructed of a hard, stable material; preferably wood. Its Foot (8D5) is inserted into the Notch and Keyhole Cutout (7D1) in the Horizontal Base (2B5). The Wishbone Shaped Cutout (8D1) in the top portion of the Vertical Support (2B4) is cut to closely match the shape of the Growler (2A1) which will be supported by the Vertical Support (2B4) with its opening oriented downward and its handle passing through the Spinal Notch (8D3) of the Wishbone Shaped Cutout (8D1) in the vicinity of the Horizontal Groove (8D2). The Horizontal Groove (8D2) running across the front face of the Vertical Support (2B4) receives the Slide Lock (2B3) which secures the Growler (2A1) to the Vertical Support (2B4). The Faucet Hole (8D4) cut in the middle of the Vertical Support (2B4) allows Connective Tubing (2B2) from the Closure System (1D9) to pass through to the Tap Faucet (2B6) assembly which is mounted in the Faucet Hole (8D4).

Slide Lock (2B3)

The Slide Lock (2B3) is the moveable portion of the support structure that secures and releases the Growler (2A1) to and from the Vertical Support (2B4). It is constructed of a hard, stable material; preferably wood. The triangular Groove Flanges (9D3) on either side of the bottom of the Slide Lock (2B3) fit into the Horizontal Groove (8D2) cut in the face of the Vertical Support (2B4). The Slide Lock (2B3) can be slid back and forth in this groove across the Spinal Notch (8D3) of the Wishbone Shaped Cutout (8D1) in the Vertical Support (2B4). The raised rectangular Thumb Grip (9D1) at one end of the Slide Lock (2B3) provides a purchase point for it to be moved back and forth. The Semi-circular Bar (9D2) of the Slide Lock (2B3) passes through the vessel's handle that is positioned in the Spinal Notch (8D3) of the Wishbone Shaped Cutout (8D1) and continues into the Horizontal Groove (8D2) on the far side. This secures the Growler (2A1) to the support system by preventing it from falling away from the Vertical Support (2B4).

Having thus described exemplary embodiments of the present invention, it should be noted by those skilled in the art that the disclosures are exemplary only and that various other alternatives, adaptations, and modifications may be made within the scope of the present invention. Accordingly, the present invention is not limited to the specific embodiments as illustrated herein, but is only limited by the following claims.

What is claimed is:

1. A closure system for sealing and dispensing from a growler type vessel comprising an L-shaped dust cover, having a lateral and vertical portion:

a turn valve having an upper surface with a recess for receiving the lateral portion of the L-shaped dust cover, a half-moon shaped opening which passes through the upper surface, and a tiered cylindrical stem with two lower stem surfaces each having different diameters and a circular-shaped channel connecting the upper surface with an opening on the side of the cylinder stem;

a cylindrical tiered cap body having an upper surface, a recessed ring-shaped area within the upper surface for receiving and securing an opening of the growler type vessel forming an air and fluid tight seal, a large diameter lower surface, a small diameter lower surface, a half-moon shaped channel running longitudinally through the cap body, and a socket open to the upper surface for receiving the cylindrical stem of the turn valve, which socket permits rotation of the cylindrical stem about a longitudinal axis and which forms a fluid tight seal with the surfaces of the cylindrical stem of the turn valve;

a bag tube, which attaches to the small diameter lower surface of the cap body; and a collapsible bladder having an opening and an expanded and deflated shape, which when deflated is gathered within the bag tube and which is connected to the small diameter lower surface of the cap body by the bag tube.

2. The closure system of claim 1, wherein the dust cover connects to the cap body and covers the circular channel in the turn valve.

3. The closure system of claim 2, wherein the connection between the dust cover and cap body is a hinged connection and the dust cover holds itself shut in the circular channel of the turn valve via a cylindrical protrusion.

4. The closure system of claim 3, wherein the hinged connection between dust cover and cap body consists of two legs with semi-spherical nodes on one end of the dust cover that fit into two detentes on a triangular prismatic protrusion of the cap body.

5. The closure system of claim 3, wherein the turn valve covers the half-moon shaped channel of the cap body when in a closed position and uncovers the half-moon shaped channel of the cap body when in an open position.

6. The closure system of claim 5, wherein the tiers of the cap body include an outer octagonal portion, and a central barrel.

7. The closure system of claim 6, wherein the hinged connection of the dust cover to the cap body is on a side of the outer octagonal portion, and the socket for the turn valve stem extends through the outer octagonal portion and into the central barrel with a circular opening located laterally on the central barrel.

8. The closure system of claim 7, wherein the circular opening located laterally on the central barrel of the cap body aligns with the exit through the circular opening of the circular channel in the cylindrical stem of the turn valve when the turn valve is in an open position exposing the half-moon shaped channel of the cap body providing a path for beer to exit the growler-type vessel through the turn valve and in the open position for air to enter the collapsible bladder through the half-moon shaped channel.

9. The closure system of claim 7, wherein the circular opening located laterally on the central barrel of the cap body is occluded by the turn valve, when the exit through the circular opening of the circular channel in the cylindrical stem of the turn valve is rotated toward the half-moon shaped channel of the cap body with the upper surface of the turn valve covering the half-moon shaped channel of the cap body in the closed position preventing beer from exiting the growler and air from entering the collapsible bladder in the growler.

10. The closure system of claim 1, wherein the socket in the cap body provides for a male/female connection between the stem of the turn valve and the socket in the cap body.

11. The closure system of claim 1, wherein the turn valve stem has a circular channel that runs from the upper surface of the turn valve through the cylindrical stem before turning to exit through a circular opening on a side of the lower tier of the cylindrical stem of the turn valve, additionally, the opening of the circular channel on the upper surface of the turn valve tapers and flares, internally, in an hourglass shape to provide a connection for a length of tubing.

12. The closure system of claim 1, wherein the two channels extend from the exterior of the cap body to the interior of the growler, when sealed.

13. The closure system of claim 1, wherein the small diameter lower surface of the cap body is tapered for frictional attachment with the bag tube.

14. The closure system of claim 13, wherein the opening of the collapsible bladder gathered within the bag tube is compressed between an interior surface of the bag tube and the small diameter lower surface of the cap body creating an air/watertight seal.

15. The closure system of claim 1, wherein the small diameter lower surface of the cap body is threaded to engage with a threaded portion on the tube.

16. The closure system of claim 15, wherein the opening of the collapsible bladder gathered within the bag tube is compressed by the small diameter lower surface of the cap body and the threaded portion on the bag tube creating an air/watertight seal.

17. The closure system of claim 1, wherein the bag tube is a hollow cylinder having an upper attachment portion and a smooth-bore end.

18. The closure system of claim 17, wherein the upper attachment portion is threaded to attach to the small diameter lower surface of the cap body that is threaded.

19. The closure system of claim 17, wherein the upper attachment portion is smooth-bore.

20. The closure system of claim 1, wherein the expand shape of the collapsible bladder has a volume equal to or greater than the volume of the growler-type vessel.

21. The closure system of claim 1, wherein the half-moon shaped channel in the cap body communicates with the interior of the collapsible bladder.

22. An assembled support structure suitable for holding a growler, having a handle and sealed with the closure system of claim 1, in an inverted position to dispense beer using gravitational flow comprising a horizontal base, a vertical support, and a slide lock, wherein the horizontal base is affixed to the vertical support, wherein the vertical support holds the growler in an inverted position, where the closure system is lower than the growler, in the inverted position, and wherein the slide lock engages the handle, thereby positioning and holding the growler in an inverted position, and wherein the slide lock slides in a groove located on the vertical support and parallel to the horizontal base, and thereby engages the handle.

23. The support structure of claim 22, wherein the horizontal base has a notch and keyhole cutout to receive the bottom portion of the vertical support.

24. The support structure of claim 23, wherein the vertical support has a wishbone shaped cutout to stabilize the growler in an inverted position with the growler handle setting in the spinal portion of the wishbone shape, a horizontal groove cut across the spinal portion of the wishbone shape to receive the slide lock, a hole in the middle to accommodate tap faucet tubing, and a notched foot to insert into the notch and keyhole cutout in the horizontal base.

25. The support structure of claim 22, wherein the slide kick secures the growler to the vertical support with a semicircular portion that passes through the growler handle when moved in the groove of the vertical support.

26. A non-pressurized system suitable for dispensing beer from a growler-type vessel employing gravitational flow comprising a growler sealed with the closure system of claim 1 and held by a support structure in an inverted position so that beer can flow from within the growler through the closure system as the collapsible bladder expands from the bag tube into the growler to take up the volume vacated by the dispensed beer.

27. A kit or dispensing liquids from a growler comprising the closure system according to claim 1 and a support structure suitable for holding a growler in a position to dispense beer using gravitational flow.

28. A method for dispensing beer from a growler sealed with the closure system according to claim 1, comprising:

introducing beer into the growler, sealing the growler with the closure system, which avoids the introduction of headspace gas, placing the sealed growler on a support so that the closure system is held in a position lower than the growler vessel, connecting the closure system to a tap with tubing, rotating the turn valve to an open position, opening the circular channel so that beer in the growler is in liquid contact with the tap via tubing while simultaneously connecting the collapsed bladder to ambient air through the half-moon shaped channel, dispensing the beer by opening the tap, allowing ambient air to expand the collapsible bladder which fills the growler vessel.

29. A method for dispensing beer from a growler sealed with the closure system according to claim 1, comprising:

dispensing the beer by opening a tap, allowing ambient air to expand the collapsible bladder which fills an inverted growler vessel.

30. The method of claim 29, wherein the turn valve is rotated to an open position, where the circular channel is opened so that beer in the growler is in liquid contact with the tap via tubing while simultaneously connecting the collapsed bladder to ambient air through the half-moon shaped channel.

* * * * *